US010490365B2

(12) United States Patent
Heinz

(10) Patent No.: US 10,490,365 B2
(45) Date of Patent: Nov. 26, 2019

(54) DIRECT-CURRENT SWITCHING DEVICE

(71) Applicant: SIEMENS AKTIENGESELLSCHAFT, Munich (DE)

(72) Inventor: Thomas Heinz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/752,970

(22) PCT Filed: Aug. 3, 2016

(86) PCT No.: PCT/EP2016/068482

§ 371 (c)(1),
(2) Date: Feb. 15, 2018

(87) PCT Pub. No.: WO2017/036710

PCT Pub. Date: Mar. 9, 2017

(65) Prior Publication Data

US 2018/0226208 A1 Aug. 9, 2018

(30) Foreign Application Priority Data

Sep. 2, 2015 (DE) ..... 10 2015 216 769

(51) Int. Cl.
*H01H 9/54* (2006.01)
*H01H 33/59* (2006.01)

(52) U.S. Cl.
CPC ..... *H01H 9/547* (2013.01); *H01H 33/596* (2013.01)

(58) Field of Classification Search
CPC ..... H01H 9/547
See application file for complete search history.

(56) References Cited

U.S. PATENT DOCUMENTS 4,618,905 A 10/1986 Tokuyama et al.
5,793,586 A 8/1998 Rockot et al.
(Continued)

FOREIGN PATENT DOCUMENTS

CN 1717857 A 1/2006
CN 102655319 A 9/2012
(Continued)

*Primary Examiner* — Daniel Kessie
(74) *Attorney, Agent, or Firm* — Laurence Greenberg; Werner Stemer; Ralph Locher

(57) ABSTRACT

A direct-current switching device for interrupting an electric direct current flowing along a medium or high-voltage current path, includes an electric circuit assembly having a mechanical switching device to be switched in the medium or high-voltage current path. The electric circuit assembly further has an LC circuit with an inductive component in order to force a current zero crossing in the mechanical switching device connected in the medium or high-voltage current path, a capacitive component for forming a resonant circuit being closed by the switching device, and a switchable semiconductor component for generating an excitation frequency exciting the resonant circuit. The switchable semiconductor component is disposed in the electric circuit assembly such that the semiconductor component constantly lies outside of the medium or high-voltage current path when the mechanical switching device is connected in the medium or high-voltage current path.

15 Claims, 2 Drawing Sheets

(56) References Cited

U.S. PATENT DOCUMENTS

| | | | | |
|---|---|---|---|---|
| 2013/0020881 | A1* | 1/2013 | Panousis | H01H 33/596 307/113 |
| 2013/0070492 | A1 | 3/2013 | Skarby | |
| 2016/0155587 | A1 | 6/2016 | Jaenicke et al. | |
| 2016/0204596 | A1* | 7/2016 | Horinouchi | H03K 17/08128 361/101 |
| 2016/0285250 | A1* | 9/2016 | Lee | H01H 9/54 |
| 2016/0322809 | A1* | 11/2016 | Wang | H02H 9/02 |

FOREIGN PATENT DOCUMENTS

| | | | |
|---|---|---|---|
| DE | 102013213602 | A1 | 1/2015 |
| EP | 0534379 | A2 | 3/1993 |
| EP | 0660352 | A1 | 6/1995 |
| JP | S60140617 | A | 7/1985 |
| WO | 2015102385 | A1 | 7/2015 |
| WO | 2016003357 | A1 | 1/2016 |

* cited by examiner

DIRECT-CURRENT SWITCHING DEVICE

BACKGROUND OF THE INVENTION

Field of the Invention

The invention relates to a direct-current switching device for interrupting a direct electric current flowing along a medium- or high-voltage current path, comprising an electric circuit arrangement, which comprises a mechanical switching device that can be switched in the medium- or high-voltage current path, wherein the electric circuit arrangement, in order to force a current zero crossing in the mechanical switching device connected in the medium- or high-voltage current path, additionally has (i) an LC-circuit with at least one inductive component and at least one capacitive component for forming a resonant circuit which is closed via the switching device, and (ii) at least one switchable semiconductor component for generating an excitation frequency which excites the resonant circuit.

A mechanical switching device from the field of medium- and high-voltage technology, such as a vacuum interrupter, requires a current zero crossing for the interruption of a current. In the currently prevailing technology for the generation, transmission and distribution of electrical energy by means of AC power, this current zero crossing is, of course, always present.

The present development in the field of the generation, transmission and distribution of electrical energy is aimed at increasing the use of systems with direct current, so that corresponding direct-current switching devices become necessary. With direct current, however, the required current zero crossing is absent and must, therefore, be artificially generated by using a mechanical switching device.

A direct-current switching device of the above-mentioned type is disclosed in US 2013/0070492 A1. This shows a direct-current switching device for interrupting a direct electric current flowing along a high-voltage current path, comprising an electric circuit arrangement, which comprises a mechanical switching device that can be switched in the high-voltage current path, wherein the electric circuit arrangement, in order to force a current zero crossing in the mechanical switching device connected in the high-voltage current path, additionally has (i) an LC-circuit with at least one inductive component and at least one capacitive component for forming a resonant circuit which is closed via the switching device, and (ii) a switchable semiconductor component for generating an excitation frequency which excites the resonant circuit.

This semiconductor component is a semiconductor component of the circuit-breaking type connected in series with the mechanical interrupter in the DC current path. By switching the semiconductor component with a frequency tuned to the active resonant circuit, an alternating current is modulated onto the direct current, which excites the resonant circuit into oscillation. If the actual current amplitude of the oscillation of this resonant circuit is larger than the direct current, or if the current amplitude of the oscillation has at least the same amplitude, then this creates the desired current zero crossing.

The semiconductor component used needs to be dimensioned for only a small part of the total voltage across the direct current switching device, and is protected by a surge arrester. This method of interrupting DC currents, —unlike in direct-current switching devices, which are based on other known methods for direct current interruption—does not require a pre-charged capacitor or a high arc-burning voltage. A great disadvantage of this switching principle is the semiconductor device connected in series with the mechanical switching device in the current path, which in the conducting state permanently generates losses, and while these can be kept to a minimum by selecting a suitable semiconductor component, they nevertheless essentially always occur.

SUMMARY OF THE INVENTION

The object of the invention is to specify a direct-current switching device for medium- and high-voltage applications, in which the above-mentioned difficulties are overcome.

The object is achieved by means of the features of the independent claims. Advantageous embodiments are specified in the dependent claims.

In the direct-current switching device according to the invention it is provided that the at least one switchable semiconductor component is arranged in the electrical circuit arrangement in such a way that the semiconductor component always lies outside of the medium- or high-voltage current path when the mechanical switching device is connected in said medium- or high-voltage current path. In other words, the at least one switchable semiconductor component is arranged in another section of the resonant circuit, thus for example in the LC-circuit, and/or in a completely different part of the electrical circuit arrangement. As a result, the direct current I that flows when the mechanical switching device is closed does not unnecessarily undergo power loss generated in the switchable semiconductor. Advantageously, a plurality of power semiconductor components is provided.

In accordance with a preferred embodiment of the invention, the at least one switchable semiconductor component is arranged in a part of the electrical circuit arrangement that is also outside of the resonant circuit.

It is then provided in particular that the part of the electrical circuit arrangement located outside of the resonant circuit has an excitation oscillator circuit coupled to the resonant circuit for exciting an oscillation of the resonant circuit, wherein the switchable semiconductor component, or at least one of the switchable semiconductor components, is arranged in this excitation oscillator circuit.

The excitation oscillator circuit is preferably inductively coupled to the resonant circuit. In particular, the coupling takes place via a transformer.

In accordance with another preferred embodiment of the invention, it is provided that the at least one switchable semiconductor component and an LC circuit of the excitation oscillator circuit are connected in a half-bridge circuit (half-bridge).

According to yet another preferred embodiment of the invention it is provided that the switchable semiconductor component, or at least one of the switchable semiconductor components, is arranged in another section of the resonant circuit, in particular in the LC-circuit thereof.

In particular, it is provided that the at least one switchable semiconductor component and the LC-circuit of the resonant circuit are connected either in a half-bridge circuit or in a full bridge circuit.

In a further advantageous embodiment, it is provided that the circuit arrangement has at least one current branch diverging from the medium- or high-voltage current path, in which the switchable semiconductor component, or at least one of the switchable semiconductor components, is connected.

In accordance with another preferred embodiment of the invention, the circuit arrangement has a voltage surge arrester connected in parallel with the mechanical switching device.

Finally, it is preferably provided that the direct-current switching device has a control and/or regulating device for the coordinated activation of the mechanical switching device and the at least one switchable semiconductor component.

The invention further relates to the use of the above-mentioned direct-current switching device for interrupting an electrical DC current I that flows along a medium- or high-voltage current path.

BRIEF DESCRIPTION OF THE SEVERAL VIEWS OF THE DRAWING

Hereafter, exemplary embodiments of the invention are shown in schematic drawings, and then described in greater detail below. These show.

DESCRIPTION OF THE INVENTION

Figure 1:
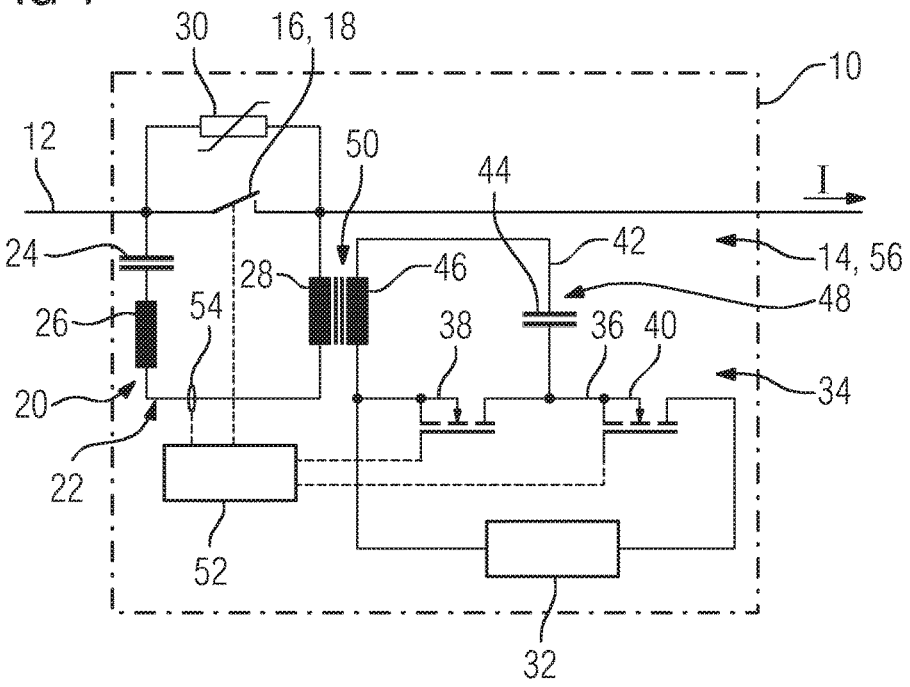
FIG. 1 a direct-current switching device according to a first preferred embodiment of the invention, FIG. 2 a direct-current switching device in accordance with a second preferred embodiment of the invention, and FIG. 3 a direct-current switching device according to a third preferred embodiment of the invention.

FIG. 1 shows a direct-current switching device 10 for interrupting a direct electrical current I flowing along a medium- or high-voltage current path 12. The direct-current switching device 10 is, of course, also suitable for switching the DC current I onto the current path 12, which is far less complicated. The direct-current switching device 10 has an electrical circuit arrangement 14, which in turn comprises a mechanical switching device 16 that can be connected (and in this specific case is in fact connected) into the medium- or high-voltage current path 12. This mechanical switching device 16 is, for example, a vacuum interrupter or other mechanical circuit breaker 18, as is also known from the currently dominant technology for the generation, transmission and distribution of electrical energy by means of alternating current in the medium- or high-voltage range. In order to form a resonant circuit 20, which is closed via the switching device 16, the electrical circuit arrangement 14 also has an LC-circuit 22 connected in parallel with the switching device 16 with one capacitive component 24 and two inductive components 26, 28. Capacitive and inductive components 24, 26, 28 are connected in series. Using this resonant circuit 20, a current zero crossing can be generated in the mechanical switching device 16 connected in the medium- or high-voltage current path 12. To this end, the resonant circuit must be forced into oscillation, in which the size of the current amplitude is greater than the direct current I to be interrupted. A surge arrester 30 is connected in parallel with the mechanical switching device 16 and in parallel with the LC-circuit 22.

The circuit arrangement 14 also has a further (circuit) part 32. This additional circuit part 32 comprises a direct-current and/or DC voltage source 34, a series circuit 36 of two semiconductor components 38, 40 connected to the DC current source 34, and a further LC-circuit 42 with a capacitive component 44 and an inductive component 46 for forming an excitation oscillator circuit 48. Capacitive and inductive components 44, 46 here are connected in series. This excitation oscillator circuit 48 is inductively coupled to the resonant circuit 20 via a transformer 50. The inductive component 46 of the additional LC-circuit 42 thus forms the primary side of the transformer 50 and the second of the inductive components 28 of the first LC circuit 22 forms the secondary side of the transformer 50. At least one of the semiconductor components 38, 40 is a switchable semiconductor component for generating an excitation frequency which excites the resonant circuit 20 extending through the switching device 16. This at least one switchable semiconductor component is arranged/interconnected in the electrical circuit assembly 14 in such a way that the semiconductor component always lies outside the medium- or high-voltage current path 12 when the mechanical switching device 16 is connected in said current path 12. The resonant circuit 20 can be selectively excited into oscillation by means of the excitation oscillator circuit 48 with the semiconductor components 38, 40 arranged therein, and is thus an active resonant circuit 20.

The direct-current switching device 10 also has a control and/or regulating device 52 for the coordinated activation of the mechanical switching device 16 and the semiconductor components 38, 40. At the same time, via a corresponding sensor 54 this measures the alternating current in the resonant circuit 20. The corresponding signal cables between the control and/or regulation device 52 and the semiconductor components 38, 40, and/or the sensor 54 are drawn as dashed lines.

In the alternative design of the direct-current switching device 10 shown in FIG. 1, the circuit arrangement 14 thus implements two resonant circuits 20, 48—in parallel with the mechanical switching device 16—coupled via the transformer 50.

In these two resonant circuits 20, 48, depending on the requirements on the transformer inductance 28, 46, an additional inductance is added (for example the inductive component 26). In the second excitation oscillator circuit 48, using a half-bridge circuit 56 formed from the two semiconductor components 38, 40 (here implemented by way of example as two MOSFETs), an oscillation is excited, which is coupled via the transformer 50 into the one resonant circuit 20. The energy for the oscillation can be extracted either from an additional direct-current and/or DC voltage source 34, or else directly from the DC power network comprising the current path 12. When using an external direct-current and/or DC voltage source 34, the semiconductor components 38, 40 can be chosen and dimensioned independently of the voltage of the DC network. In this case, however, the transformer 50 must ensure a corresponding electrical isolation between the two resonant circuits 20, 48. The excitation oscillator circuit 48 is operated by the control and/or regulation device 52 such that the resonant circuit 20 oscillates in resonance. This may take place, for example, by changing over the semiconductor components 38, 40 in the excitation resonant circuit 48, as soon as the current in the resonant circuit 20 undergoes a zero-crossing. If, for example the current in the resonant circuit 20 is positive, then semiconductor component 38 is turned off and semiconductor component 40 is turned on; if, on the other hand, the current in the resonant circuit 20 is negative, then semiconductor component 38 is turned on and semiconductor component 40 is turned off. In this process, current and voltage in the resonant circuit 20 are in phase and the current can oscillate with maximum amplitude. In order to protect the circuit arrangement 14 against over-voltages during a turn-off operation and to absorb the energy present in the system, the surge arrester (for example a MO-varistor) 30 is integrated in parallel with the mechanical switch.

This results in the following function:

In normal operation, the mechanical switching device 16 is closed and the semiconductor components 38, 40 are not activated. The conduction losses of the entire direct-current switching device 10 are limited to the low Ohmic losses of the closed mechanical switching device 16.

In the switched case, for example, in the event of a fault in the connected DC power network, the switching device 16 is opened. To generate an artificial current zero crossing, the two semiconductor components 38, 40 are activated accordingly, so that a current oscillation is superimposed on the direct current, which gives rise to an artificial current zero in the switching device 16 and therefore to an interruption of the current. Once the mechanical switching device 16 has interrupted the current, the activation of the semiconductor components can be switched off.

Subsequently, the current commutates first onto the resonant circuit 20 and the capacitive component 24 is charged up. Once the capacitive component 24 has reached the voltage level of the surge arrester 30, the current commutates once again onto the parallel current path with the surge arrester 30, this absorbs the energy present in the connected network and ultimately brings the direct current down to zero. The switch-off process is thereby completed. In this design variant of the direct-current switching device 10 a bipolar operation without additionally reverse connected semiconductors is possible.

Figure 2:
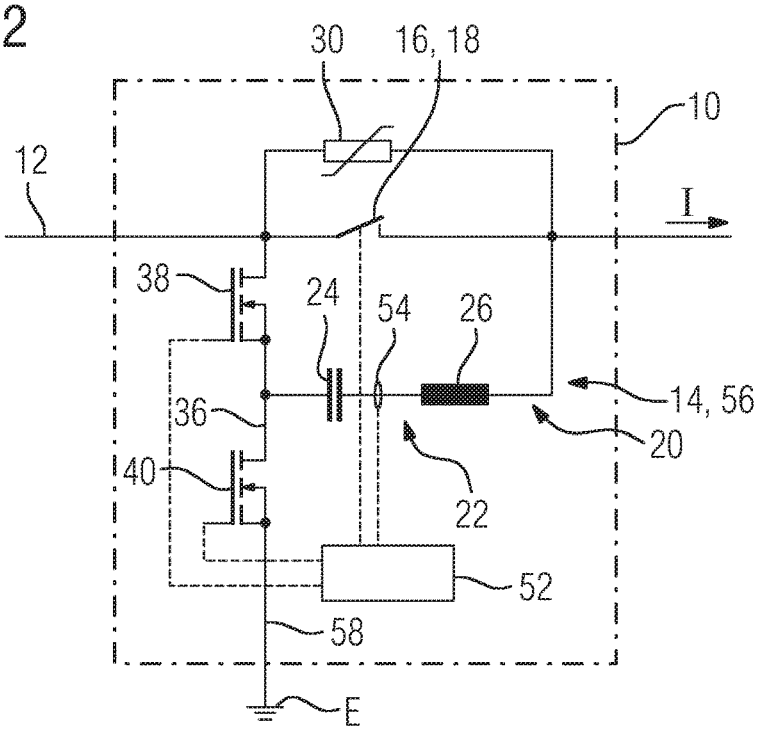
Figure 3:
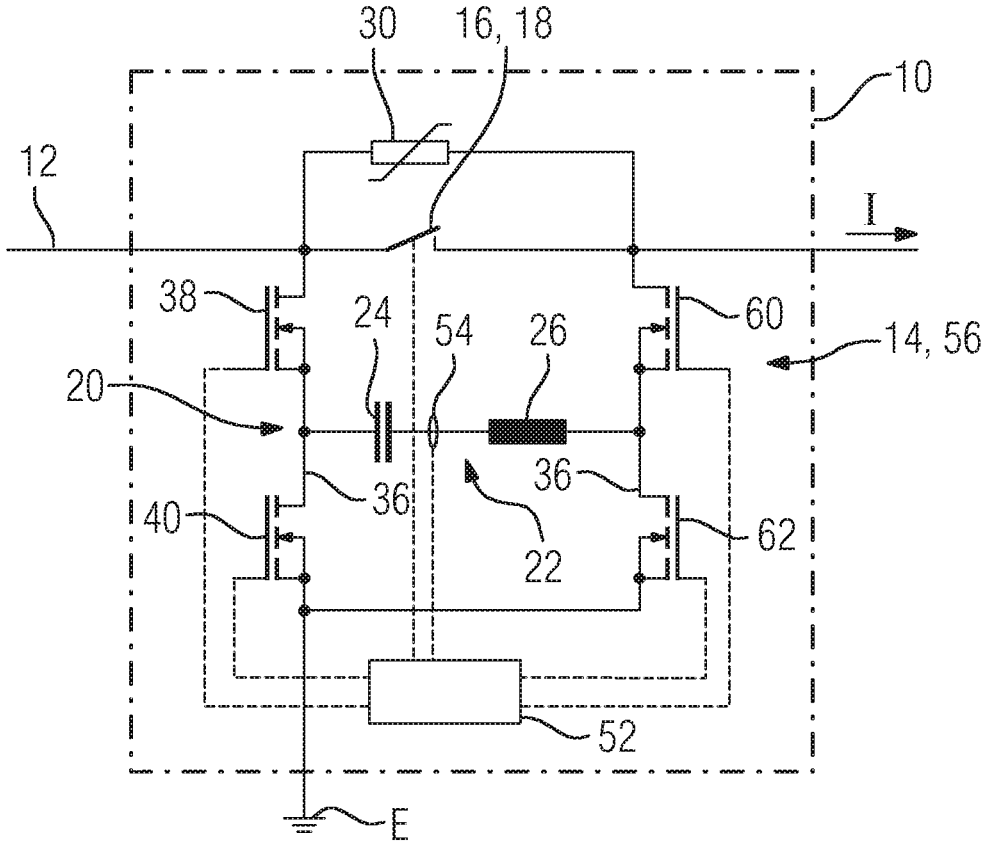

The FIGS. 2 and 3 show other exemplary embodiments of the direct-current switching device 10, which substantially correspond to the exemplary embodiment of FIG. 1, so that only the differences will be discussed below.

In the design variant of the direct-current switching device 10 shown in FIG. 2 with active resonance excitation, semiconductor components 38, 40 are a prerequisite, each of which can block the full DC voltage. With two semiconductor components 38, 40 a unipolar direct-current switching device 10 can be assembled. To this end, the direct-current switching device 10 has a current branch 58 diverging from the medium- or high-voltage current path 12, in which the two semiconductor components 38, 40 are interconnected in a series circuit 36. This current branch 58 leads to a reference potential, in the example shown to an earth E with corresponding earth potential E. A half-bridge circuit (half-bridge) 56 is again produced, only this time with the series circuit 36 of the semiconductor components 38, 40 and the LC-circuit 22 of the active resonant circuit 20 connected in parallel with one of the semiconductor components 38. In other words, the two semiconductor components 38, 40 are arranged between the supply and return conductors of the current path 12 before the mechanical switching device 16. The LC-circuit 22 is contacted on the one hand between the two semiconductor components 38, 40 and on the other hand, behind the mechanical switching device 16. In parallel with the mechanical switching device 16, the surge arrester 30 (implemented for example with MO varistors) is connected to provide protection against voltage surges. In this alternative design variant, the excitation oscillator circuit 48 and the transformer 50 can be omitted.

In normal operation, the mechanical switching device 16 is closed and neither of the two semiconductor components 38, 40 is activated. Here, too, the conduction losses are limited to the low Ohmic losses of the closed mechanical switching device 16.

If the DC current I were to be switched off, the switching device 16 is opened. If the switching contacts of the switching device 16 are a sufficiently large distance apart from each other, so that the switching device 16 can isolate the applied DC voltage after a successful current interruption, the semiconductor components 38, 40 are turned alternately on and off (in practice, component 40 is first turned on and device 38 turned off). The switching frequency is selected (by the control and/or regulation device 52) such that the (active) resonant circuit 20 oscillates at resonance, to obtain a maximum possible current amplitude. If the current oscillation has a higher amplitude than the direct current I which is to be switched off, then artificially generated current zero crossings are produced in the switching device 16 and the direct current I can be interrupted. To control the steepness of the resulting recovering voltage (TRV—transient recovery voltage), by switching off semiconductor component 40 and simultaneously switching on semiconductor device 38 the resonant circuit 20 can remain connected in parallel after the current interruption in the mechanical switching device 16. Only then, the current commutates onto the resonant circuit 20 and charges the capacitive component 24. If the voltage level is reached, which causes the surge arrester 30 to have a low impedance, the current once again commutates onto the parallel current path with the surge arrester 30 and the latter ultimately brings the direct current I to zero. The shutdown process is thus complete.

If a DC switch according to variant two is used in a DC power supply with a changing current direction (bipolar operation), then an interconnection according to FIG. 3 is appropriate. In this variant, a bipolar direct-current switching device 10 is formed with four semiconductor components 38, 40, 60, 62. In this case, to form the resonant circuit 20 passing through the switching device 16, the semiconductor components 38, 40, 60, 62 and the LC-circuit 22 are connected in a bridge circuit 64. The first two semiconductor components 38, 40 are arranged before the mechanical switching device 16 between the supply and return conductors of the current path 12. The LC-circuit 22 is contacted on the one hand between the two semiconductor components 38, 40 and on the other hand, between the other two semiconductor components 60, 62, which are arranged behind the mechanical switching device 16. The surge arrester 30 (implemented for example with MO varistors) is connected in parallel with the mechanical switching device 16 here also, to provide protection against voltage surges. In this design variant also, the excitation oscillator circuit 48 and the transformer 50 can be omitted.

In this direct-current switching device 10, in the switched case during the activation of the semiconductor components 38, 40, 60, 62, depending on the direction of current flow in the current path 12, one of the two semiconductor components 38, 60 directly connected to the current path 12 must remain permanently switched on during the switching operation, so that the current oscillation described above can be generated by the two opposite semiconductor components 60, 62; 38, 40. The basic operating and switching behaviour can otherwise be implemented in an equivalent manner to the switch concept of the direct-current switching device 10 shown in FIG. 2. Due to the four separately switchable semiconductor components 38, 40, 60, 62, in this version of the direct-current switching device 10 the degrees of freedom are higher, however. Thus, for example, by the diagonal activation of two semiconductor components (for example 38, 62, and/or 40, 60) the capacitive component 24 of the LC-circuit 22 can be pre-charged via the DC power supply, to directly achieve a current oscillation with maximum amplitude in the switched case and to be able to interrupt fault currents faster.

In principle, in the DC switching concepts presented in FIGS. 1-3, switching can also take place "proactively". To this end, the semiconductor components 38, 40, 60, 62 must be activated even before the opening of the mechanical switching device 16. In this case, the switching device 16 already undergoes current zero crossings before it has opened. If there is a possibility of a switching operation, then the current oscillation can already be initiated and if a power interruption is necessary, it is possible to open the switching device 16 directly, in order thus to shorten the entire switch-off time.

Instead of the individual mechanical switching device 16 shown in the exemplary embodiments, this can alternatively be replaced in the direct-current switching device 10 by a series connection of a plurality of mechanical switching devices 16 that can be connected in the medium- or high-voltage current path 12. By means of such a series circuit, even when using standard switching devices 16 the corresponding direct-current switching device 10 can be designed to be applicable to high-voltage current paths 12.

REFERENCE NUMERALS

10 direct-current switching device
12 current path
14 circuit arrangement 10
16 switching device, mechanical
18 circuit breaker
20 resonant circuit
22 LC-circuit
24 component, capacitive
26 component, inductive
28 component, inductive
30 surge arrester
32 part of circuit, additional
34 direct-current and/or DC voltage source
36 series circuit
38 semiconductor component, switchable
40 semiconductor component, switchable
42 LC-circuit, additional
44 component, capacitive
46 component, inductive
48 excitation oscillator circuit
50 transformer
52 control and/or regulation device
54 sensor
56 half-bridge circuit
58 series circuit
60 semiconductor component, switchable
62 semiconductor component, switchable
64 full bridge circuit
I direct current
E earth

The invention claimed is:

1. A direct-current switching device for interrupting a direct electric current flowing along a medium-voltage or high-voltage current path, the direct-current switching device comprising:

an electric circuit configuration including a mechanical switching device to be switched in the medium-voltage or high-voltage current path, said electric circuit configuration, in order to force a current zero crossing in said mechanical switching device connected in the medium-voltage or high-voltage current path, additionally including:

an LC circuit having at least one inductive component and at least one capacitive component forming a resonant circuit being closed by said mechanical switching device, and at least one switchable semiconductor component for generating an excitation frequency exciting said resonant circuit;

said at least one switchable semiconductor component being disposed in said electric circuit configuration in such a way that said at least one switchable semiconductor component constantly always lies outside of the medium-voltage or high-voltage current path when said mechanical switching device is connected in the medium-voltage or high-voltage current path; and another part of said electric circuit configuration lying outside of said resonant circuit, said at least one switchable semiconductor component being disposed in said other part of said electrical circuit configuration;

said other part of said electrical circuit configuration including an excitation oscillator circuit coupled to said resonant circuit for exciting an oscillation of said resonant circuit, said at least one switchable semiconductor component being disposed in said excitation oscillator circuit; and said excitation oscillator circuit including an LC-circuit, and said at least one switchable semiconductor component and said LC-circuit being connected to a half-bridge circuit.

2. The direct-current switching device according to claim 1, wherein said other part of said electrical circuit configuration includes an excitation oscillator circuit coupled to said resonant circuit for exciting an oscillation of said resonant circuit, said at least one switchable semiconductor component includes a plurality of switchable semiconductor components, and at least one of said switchable semiconductor components is disposed in said excitation oscillator circuit.

3. The direct-current switching device according to claim 1, wherein said excitation oscillator circuit is inductively coupled to said resonant circuit.

4. The direct-current switching device according to claim 1, wherein said resonant circuit has a different section, and said at least one switchable semiconductor component is disposed in said different section of said resonant circuit.

5. The direct-current switching device according to claim 4, wherein said different section of said resonant circuit is said LC-circuit.

6. The direct-current switching device according to claim 1, wherein said resonant circuit has a different section, said at least one switchable semiconductor component includes a plurality of switchable semiconductor components, and at least one of said switchable semiconductor components is disposed in said different section of said resonant circuit.

7. The direct-current switching device according to claim 6, wherein said different section of said resonant circuit is said LC-circuit.

8. The direct-current switching device according to claim 1, wherein said at least one switchable semiconductor component and said LC-circuit of said excitation oscillator circuit are connected to a half-bridge circuit or in a bridge circuit.

9. The direct-current switching device according to claim 1, wherein said circuit configuration has at least one current branch diverging from the medium-voltage or high-voltage current path, said at least one switchable semiconductor component being connected in said at least one current branch.

10. The direct-current switching device according to claim 1, wherein said circuit configuration has at least one current branch diverging from the medium-voltage or high-voltage current path, said at least one switchable semiconductor component includes a plurality of switchable semiconductor components, and at least one of said switchable semiconductor components is connected in said at least one current branch.

11. The direct-current switching device according to claim 1, wherein said circuit configuration includes an overvoltage arrester connected in parallel with said mechanical switching device.

12. The direct-current switching device according to claim 1, which further comprises at least one of a control or regulating device for coordinated activation of said mechanical switching device and said at least one switchable semiconductor component.

13. A direct-current switching device for interrupting a direct electric current flowing along a medium-voltage or high-voltage current path, the direct-current switching device comprising:

an electric circuit configuration including a mechanical switching device to be switched in the medium-voltage or high-voltage current path, said electric circuit configuration, in order to force a current zero crossing in said mechanical switching device connected in the medium-voltage or high-voltage current path, additionally including:

an LC circuit having at least one inductive component and at least one capacitive component forming a resonant circuit being closed by said mechanical switching device, and at least one switchable semiconductor component for generating an excitation frequency exciting said resonant circuit;

said at least one switchable semiconductor component being disposed in said electric circuit assembly in such a way that said at least one switchable semiconductor component constantly always lies outside of the medium-voltage or high-voltage current path when said mechanical switching device is connected in the medium-voltage or high-voltage current path; and a different section of said resonant circuit, said different section of said resonant circuit is said LC-circuit, said at least one switchable semiconductor component including a plurality of switchable semiconductor components, and at least one of said switchable semiconductor components being disposed in said different section of said resonant circuit;

said at least one switchable semiconductor component and said LC-circuit are connected to a half-bridge circuit or in a bridge circuit.

14. The direct-current switching device according to claim 13, which further comprises another part of said electrical circuit configuration lying outside of said resonant circuit, said at least one switchable semiconductor component being disposed in said other part of said electrical circuit configuration.

15. The direct-current switching device according to claim 14, wherein said other part of said electrical circuit configuration includes an excitation oscillator circuit coupled to said resonant circuit for exciting an oscillation of said resonant circuit, said at least one switchable semiconductor component being disposed in said excitation oscillator circuit.

* * * * *